US007334444B2

(12) United States Patent
Sandner et al.

(10) Patent No.: US 7,334,444 B2
(45) Date of Patent: Feb. 26, 2008

(54) METHOD FOR PRODUCING A GEARWHEEL

(75) Inventors: Christian Sandner, Gmunden (AT); Horst Rössler, Wels (AT)

(73) Assignee: Miba Sinter Austria GmbH, Laakirchen (AT)

( * ) Notice: Subject to any disclaimer, the term of this patent is extended or adjusted under 35 U.S.C. 154(b) by 0 days.

(21) Appl. No.: 10/582,732

(22) PCT Filed: Dec. 13, 2004

(86) PCT No.: PCT/AT2004/000436

§ 371 (c)(1),
(2), (4) Date: Jun. 13, 2006

(87) PCT Pub. No.: WO2005/058524

PCT Pub. Date: Jun. 30, 2005

(65) Prior Publication Data

US 2007/0107481 A1 May 17, 2007

(30) Foreign Application Priority Data

Dec. 19, 2003 (AT) ..... A 2054/2003

(51) Int. Cl.
*B21H 1/12* (2006.01)

(52) U.S. Cl. ..... 72/91; 72/102; 72/125; 29/893.32

(58) Field of Classification Search ..... 29/893.32; 72/91, 102, 125, 295, 296, 312
See application file for complete search history.

(56) References Cited

U.S. PATENT DOCUMENTS

| | | | | |
|---|---|---|---|---|
| 5,659,955 | A | 8/1997 | Plamper et al | |
| 5,824,168 | A * | 10/1998 | Miyamoto et al. | 148/573 |
| 6,357,272 | B1 * | 3/2002 | Sandner | 72/91 |

FOREIGN PATENT DOCUMENTS

| | | |
|---|---|---|
| AT | 406 836 B | 9/2000 |
| EP | 0 552 272 B1 | 12/1994 |
| GB | 2 250 227 A | 6/1992 |
| JP | 59 115120 A | 7/1874 |
| JP | 62 057726 A | 8/1987 |

OTHER PUBLICATIONS

International Search Report in English.

* cited by examiner

*Primary Examiner*—Ed Tolan
(74) *Attorney, Agent, or Firm*—Collard & Roe, P.C.

(57) ABSTRACT

A method is described for producing a gearwheel from a powder-metal blank which is pressed and sintered with an allowance in the toothing region, with the powder metal blank supported on a mandrel being densified in the region of the allowance by pressing on counter-toothing of a circular pusher tool engaging in the toothing of the powder metal blank under plastic deformation by the allowance. In order to ensure precise production it is proposed that during its densification the powder metal blank is radially clamped on both face sides over the circumference.

6 Claims, 2 Drawing Sheets

METHOD FOR PRODUCING A GEARWHEEL

CROSS REFERENCE TO RELATED APPLICATIONS

Applicants claim priority under 35 U.S.C. §119 of Austrian Application No. A 2054/2003 filed Dec. 19, 2003. Applicants also claim priority under 35 U.S.C. §365 of PCT/AT2004/000436 filed Dec. 13, 2004. The international application under PCT article 21(2) was not published in English.

FIELD OF THE INVENTION

The invention relates to a method for producing a gearwheel from a powder-metal blank which is pressed and sintered with an allowance in the toothing region, with the powder metal blank supported on a mandrel being densified in the region of the allowance by pressing on counter-toothing of a circular pusher tool engaging in the toothing of the powder metal blank under plastic deformation by the allowance.

DESCRIPTION OF THE PRIOR ART

In order to avoid a comparatively low bending endurance in the region of the tooth roots and a low wear resistance in the region of the tooth flanks in gearwheels produced by powder metallurgy it is known (EP 0 552 272 B1, AT 406 836B) to densify the sintered powder metal blanks of the gearwheels in the flank and root region of the teeth, so that a substantially pore-free surface layer is obtained which leads in the meshing region of the gearwheel to a considerable increase in the permissible load capacity. The densification of the surface layer in the meshing region of the gearwheel occurs by way of a pushing tool in the form of at least one gearwheel which has an external tooth system (EP 0 552 272 B1) or an internal tooth system (AT 406 836 B) engaging in the toothing of the powder metal blank, with the help of which the sliding speed between the tooth flanks of the powder metal blank and the pushing tool can be reduced. Irrespective of the type of employed pushing tool, there is likelihood however that the pressing forces occurring locally between the pushing tool and a mandrel receiving the gearwheel will lead to a plastic deformation of the entire wheel cross section, leading not only to an insufficient densification of the tooth flanks, but also to an impermissible enlargement of the wheel circumference, especially in the case of gearwheels with an inside diameter which is comparatively large compared with the root circle.

SUMMARY OF THE INVENTION

The invention is thus based on the object of providing a method for producing a gearwheel of the kind mentioned above in such a way that an advantageous densification of the powder metal blank produced with allowance in the toothing region can be ensured without having to consider any increase in the wheel circumference.

This object is achieved by the invention in such a way that during its densification the powder metal blank is radially clamped on both face sides over the circumference.

By clamping the powder metal blank on both face sides, the pressing forces which are otherwise locally limited to the engagement region of the pushing tool are distributed over the circumference of the powder metal blank with the effect that an increase of the wheel circumference is prevented and the densification of the powder metal blank is limited substantially to the allowance region of the toothing. For the purpose of radially clamping the powder metal blank over its circumference, the powder metal blank can be axially clamped in a simple manner between two pressure rings, non-positive and positive connections being possible. It is merely intended to radially clamp the powder metal blank without obstructing the densification by the pushing tool in the toothing region. For this purpose, radial shear forces can be carried off from the powder metal blank to the pressure rings via the frictional connection caused by the axial clamping of the powder metal blank between the pressure rings. A respective carrying off of forces can obviously also be achieved or supported by positive locking when said positive locking allows a transmission of forces in the radial direction.

For performing the method, a known apparatus can be assumed which comprises a mandrel for supporting the powder metal blank of the gearwheel to be produced which is sintered and pressed with allowance and at least one pushing tool which engages with a counter-toothing in the toothing of the powder metal blank. When two pressure rings are provided in such an apparatus, which pressure rings are coaxial to the mandrel and axially clamp the powder metal blank between themselves, then the powder metal blank can be radially clamped over the circumference between said axially pressed pressure rings in order to prevent an increase in the wheel circumference as a result of the thus caused absorption of a part of the forces active in the engagement region of the pushing tool on the powder metal blank between the pushing tool and the mandrel without obstructing the densification in the toothing region.

In order to provide simple constructional conditions, one of the two pressure rings can be axially supported relative to the mandrel, whereas the other pressure ring is connected with an axial actuator. The axial clamping forces can be exerted by the pressure rings onto the powder metal blank via said actuator.

If the radial clamping of the powder metal blank is to be supported on its two face sides at least by positive locking, the pressure rings and/or the powder metal blank can comprise axially projecting, circumferential noses for positive-locking connection between the powder metal blank and the pressure rings. Said circumferential noses can engage in annular recesses or axially overlap respective shoulders in order to ensure positive locking which is effective in the radial direction. The noses or recesses provided in the region of the powder metal blank can be removed again after the densification of the toothing region.

BRIEF DESCRIPTION OF THE DRAWINGS

The method in accordance with the invention for producing a gearwheel is explained in closer detail below by reference to the drawing, wherein.

DESCRIPTION OF THE PREFERRED EMBODIMENT

Figure 1:
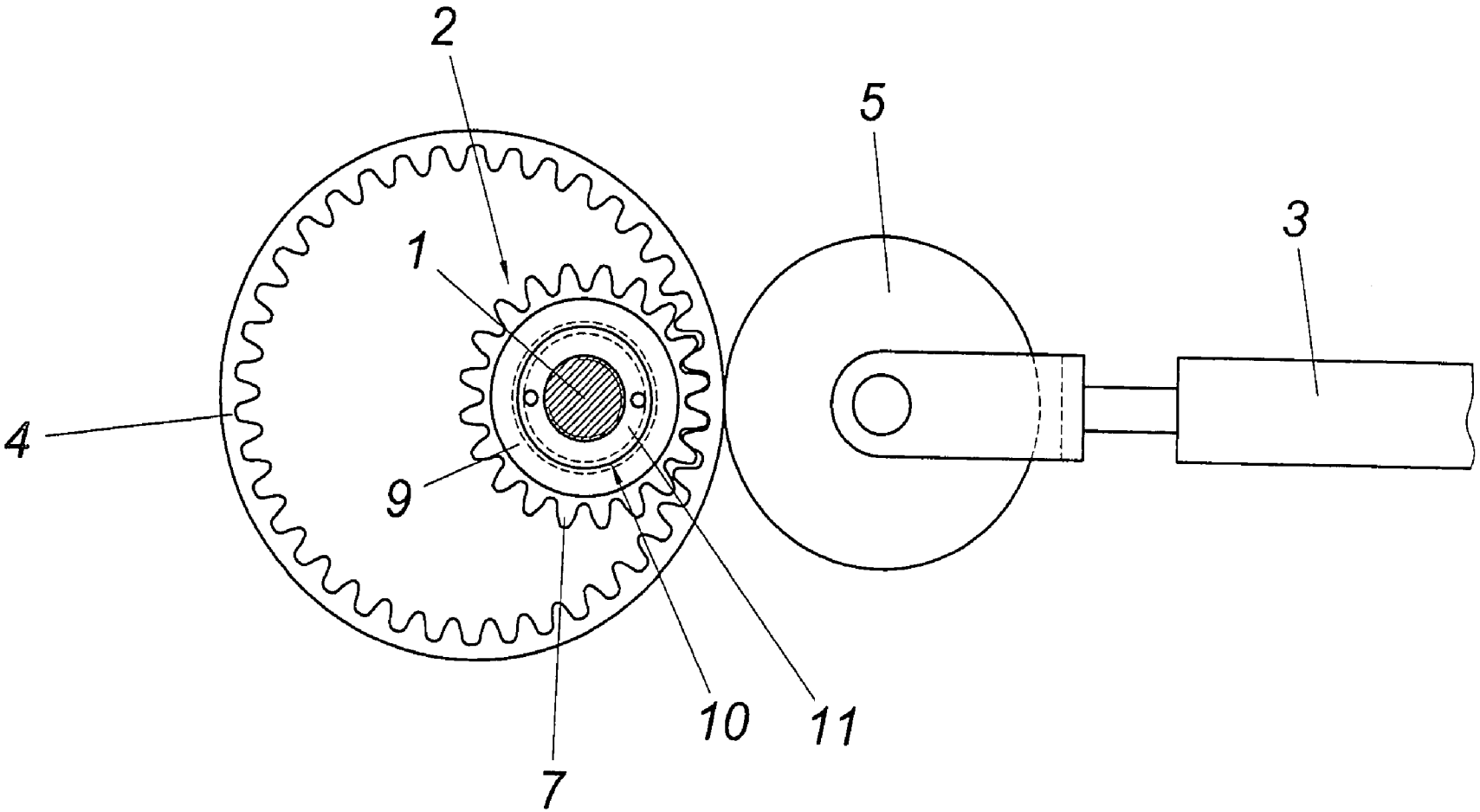
FIG. 1 shows an apparatus in accordance with the invention for performing the method in a schematic side view.

The apparatus according to FIG. 1 comprises a mandrel 1 for receiving a powder metal blank 2 to be processed and a pressure roller 5 which can be applied via an actuator 3, e.g. a hydraulic cylinder, to a pushing tool 4. The pushing tool 4 consists of a gear rim with an internal gear 6 which cooperates as a counter-toothing with the toothing 7 of the powder metal blank 2. Since the teeth of the powder metal blank 2 were sintered with a respective allowance in the flank and root region, but the teeth of the internal gear 6 of the pushing tool 4 are configured according to the specified size of the teeth of the gearwheel to be produced, the tooth flanks and roots in the region of the allowance are densified by the pressed teeth of the pushing tool 4 under plastic deformation, with the densification occurring step by step because the powder metal blank is processed in several cycles.

To ensure that there is no plastic deformation of the entire gearwheel cross-section by the application of force limited locally to the area of influence of the pushing tool 4 which is linked to an increase in the wheel circumference, the powder metal blank 2 is radially clamped. over the circumference on its two face sides, which prevents an extension of the wheel circumference. The pushing forces which are otherwise locally limited to the tooth engagement area can thus be removed in a manner distributed over the entire wheel circumference. The forces distributed over the circumference exclude an overload of the wheel body. The necessary densification of the toothing in the region of the allowance is ensured nevertheless because the toothing lies outside of the clamped region of the powder metal blank.

Figure 2:
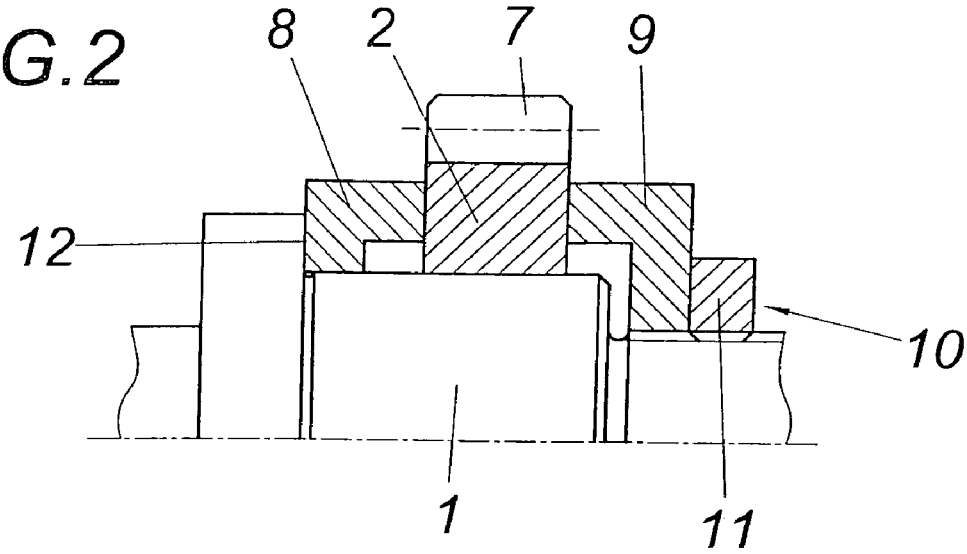
FIG. 2 shows a simplified axial sectional view on an enlarged scale of a powder metal blank supported on a mandrel and clamped between two face-side pressure rings.

Two pressure rings 8, 9 are provided according to FIG. 2 for radially clamping the powder metal blank 2 over its circumference. The powder metal blank 2 is axially clamped between said two pressure rings. An actuator 10 is used for pressurizing said pressure rings 8, 9, which actuator is configured in the embodiment as nut 11 which is held adjustable by screwing in the axial direction on mandrel 1 and presses the pressure ring 9 against the powder metal blank 2 which rests on the pressure ring 8. The pressure ring 8 rests on one shoulder 12 of the mandrel 1 and is axially fixed by said shoulder 12. Since the pressure rings 8, 9 are pressed with their face sides against the face sides of the powder metal blank 2, a positive locking is obtained by which radial pushing forces can be carried off from the powder metal blank 2 onto the pressure rings 8, 9. The pushing forces which become effective in the region of the wheel body are thus are distributed by the radial support of the powder metal blank 2 not only over the wheel circumference, but partly also carried off onto the pressure rings 8 and 9.

Figure 3:
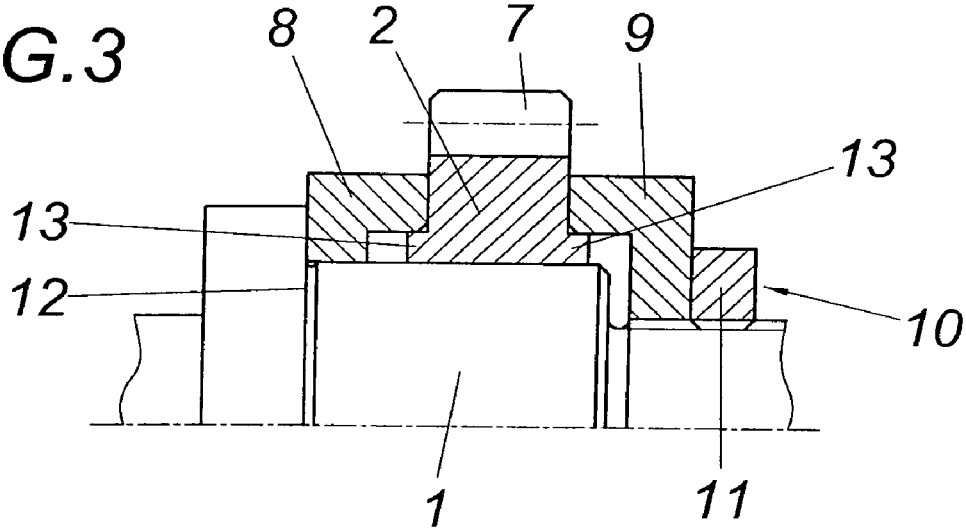
FIG. 3 shows an illustration corresponding to FIG. 2 of a constructional variant of the radial clamping of the powder metal blank.

In accordance with FIG. 3, the positive-locking connection between the powder metal blank 2 on the one hand and the pressure rings 8, 9 on the other hand is supplemented by a positive-locking connection. For this purpose the powder metal blank 2 forms axially projecting noses 13 which lead to annular shoulders overlapped by the pressure rings 8, 9, so that a positive-locking support of the powder metal blank 2 on the pressure rings 8, 9 is obtained via these annular shoulders.

Figure 4:
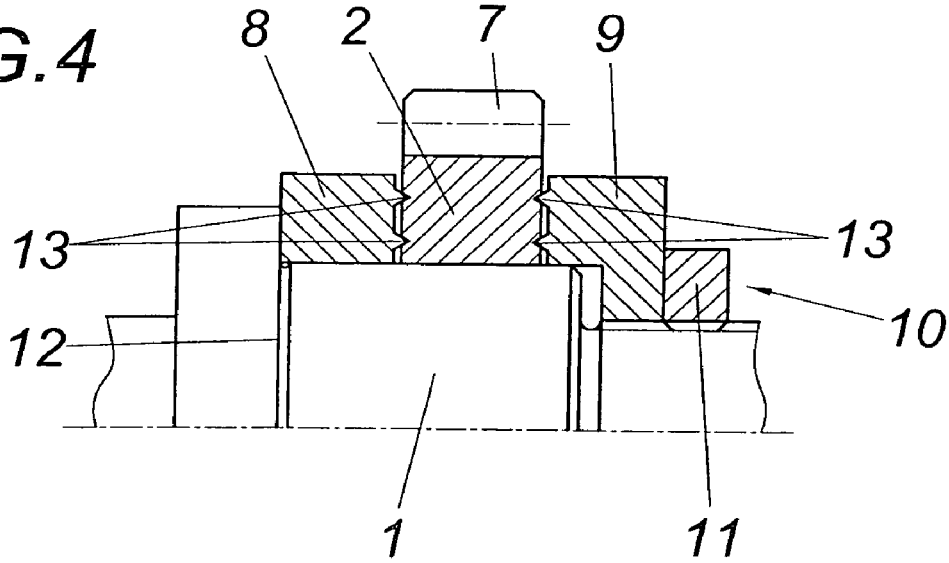
FIG. 4 shows a simplified axial sectional view of a further embodiment of a radial clamping of the powder metal blank.

As is shown in FIG. 4, the radial clamping of the powder metal blank 2 can also occur only in a non-positive manner when the connection between the powder metal blank 2 and the pressure rings 8, 9 occurs by way of circumferential radial noses 13 of the pressure rings 8, 9 which press into the face sides of the powder metal blank 2 and thus produce the desired positive locking in the radial direction.

The invention claimed is:

1. A method of producing a gearwheel from a powder metal blank, the powder metal blank having two opposite end faces and a circumference, and the powder metal blank being pressed and sintered with an allowance in a region of toothing extending radially from the circumference, the method comprising the steps of (a) supporting the powder metal blank on a mandrel, (b) densifying the powder metal blank in the region of the allowance by pressing on a counter-toothing of a circular pusher tool engaging the toothing of the powder metal blank under plastic deformation by the allowance, and (c) clamping the two opposite end faces at the circumference to prevent radial movement thereof during densification.

2. The method of claim 1, wherein two pressure rings are pressed axially against the two opposite end faces of the powder metal blank at the circumference to prevent radial movement thereof.

3. An apparatus for performing the method of claim 1, which comprises (a) a mandrel supporting the metal powder blank, (b) a circular pusher tool having counter-toothing engaging the toothing of the powder metal blank, and (c) two pressure rings coaxial with the mandrel and pressing axially against the opposite end faces of the powder metal blank at the circumference thereof to clamp the powder metal blank therebetween.

4. The apparatus of claim 3, wherein one of the pressure rings is axially supported on the mandrel, further comprising an actuator for pressing the other pressure ring against the end face opposite to the one pressure ring.

5. The apparatus of claim 3, wherein the powder metal blank and the pressure rings are in a positive locking connection.

6. The apparatus of claim 5, wherein noses on the pressure rings engaging matching recesses in the powder metal blank provide the positive locking connection.

* * * * *